US009799464B2

(12) United States Patent
Wang et al.

(10) Patent No.: US 9,799,464 B2
(45) Date of Patent: Oct. 24, 2017

(54) KEY ASSEMBLY

(71) Applicant: Acer Incorporated, New Taipei (TW)

(72) Inventors: Chih-Kai Wang, New Taipei (TW); Wen-Shu Lee, New Taipei (TW)

(73) Assignee: Acer Incorporated, New Taipei (TW)

( * ) Notice: Subject to any disclaimer, the term of this patent is extended or adjusted under 35 U.S.C. 154(b) by 0 days.

(21) Appl. No.: 14/931,816

(22) Filed: Nov. 3, 2015

(65) Prior Publication Data

US 2017/0076878 A1 Mar. 16, 2017

(30) Foreign Application Priority Data

Sep. 15, 2015 (TW) ..... 104130373 A

(51) Int. Cl.

| | |
|---|---|
| ***H01H 35/24*** | (2006.01) |
| ***H01H 13/06*** | (2006.01) |
| ***H01H 13/14*** | (2006.01) |
| ***H01H 35/34*** | (2006.01) |
| ***H01H 35/30*** | (2006.01) |

(52) U.S. Cl.

CPC ..... *H01H 13/06* (2013.01); *H01H 13/14* (2013.01); *H01H 35/245* (2013.01); *H01H 35/30* (2013.01); *H01H 35/34* (2013.01)

(58) Field of Classification Search

CPC ..... H01H 13/06; H01H 13/063; H01H 13/14; H01H 35/30; H01H 35/34; H01H 35/245

USPC ..... 200/81.8, 83 R, 83 Z, 81 H, 211, 200/215–219, 515

See application file for complete search history.

(56) References Cited

U.S. PATENT DOCUMENTS

| | | | | |
|---|---|---|---|---|
| 2,720,108 A * | 10/1955 | Johnson | G01N 27/185 200/81 H |
| 4,647,738 A * | 3/1987 | Diamond | H01H 3/24 200/306 |
| 4,754,107 A * | 6/1988 | Tracey | H01H 3/24 200/81 H |
| 7,348,509 B2 * | 3/2008 | Severson | H01H 5/18 200/83 J |
| 8,274,004 B2 * | 9/2012 | Selzer | H01H 35/343 200/83 Z |

(Continued)

FOREIGN PATENT DOCUMENTS

| | | |
|---|---|---|
| CN | 202616099 | 12/2012 |
| DE | 202006010119 | 9/2006 |

(Continued)

*Primary Examiner* — Felix O Figueroa
(74) *Attorney, Agent, or Firm* — JCIPRNET

(57) ABSTRACT

A key assembly configured to an electronic device is provided. The key assembly includes a switch component and a flexible button. The switch component is disposed in a case of the electronic device. The flexible button has a pressing portion, a shaft portion, at least one water-resistant portion and an actuating portion. The pressing portion is exposed from the case. The shaft portion connects the pressing portion and the actuating portion, and passes through a through hole of the case. The water-resistant portion is connected to the shaft portion and covers the through hole. The actuating portion is located in the case and aligned to the switch component. When a force is applied to the pressing portion, the pressing portion produces compressive deformation and makes the actuating portion produce expensive deformation to actuate the switch component.

9 Claims, 2 Drawing Sheets

(56) References Cited

U.S. PATENT DOCUMENTS

2011/0036701 A1* 2/2011 Wang ..... H01H 13/705
200/512

FOREIGN PATENT DOCUMENTS

| | | |
|---|---|---|
| JP | 2015-069827 | 4/2015 |
| TW | 209094 | 7/1993 |
| TW | 201108282 | 3/2011 |

* cited by examiner

KEY ASSEMBLY

CROSS-REFERENCE TO RELATED APPLICATION

This application claims the priority benefit of Taiwan application serial no. 104130373, filed on Sep. 15, 2015. The entirety of the above-mentioned patent application is hereby incorporated by reference herein and made a part of this specification.

BACKGROUND OF THE INVENTION

Field of the Invention

The invention is related to a key assembly, and particularly related to a key assembly suitable for an electronic device.

Description of Related Art

In recent years, most technology products feature mobility and functions. Gradually, portable electronic devices, e.g., smart phones, tablet PC and notebook computers become popular in the electronic product markets.

Generally speaking, a portable electronic device is provided with a keypad on a case, wherein the case is equipped with a switch component configured in corresponding to the keypad. In the meantime, the keypad and the switch component are coupled to each other to form a key assembly. With such configuration, a user may press the keypad to control the switch component so as to control power supply, Bluetooth or Wi-Fi, or perform functions such as adjusting the volume, recording image, or rolling pages and the like. On the other hand, the case of most portable electronic devices is provided with an opening for accommodating the key assembly. Since a conventional key assembly has a bigger size with configuration of a keypad, a spring, a water-resistant member and a retaining ring, it is unlikely to effectively reduce the size of the opening for accommodating the key assembly; consequently, it is easy for ambient moisture or dust to enter the interior of the portable electronic device via the opening.

SUMMARY OF THE INVENTION

The invention provides a key assembly which meets the demand for reduced-size design and easy for assembling and repairing.

The invention provides a key assembly for being configured in an electronic device. The key assembly includes a switch component and a flexible button. The switch component is disposed in the case of the electronic device. The flexible button has a pressing portion, a shaft portion, at least one water-resistant portion and an actuating portion. The pressing portion is exposed from the case. The shaft portion connects the pressing portion and the actuating portion, and passes through a through hole of the case. The water-resistant portion is connected to the shaft portion and covers the through hole. The actuating portion is located in the case and aligned to the switch component. When a force is applied to the pressing portion, the pressing portion produces compressive deformation and makes the actuating portion produce expensive deformation to actuate the switch component.

Based on the above, in the invention, the flexible button of the key assembly may be an integrally formed structure which is easy to be assembled to the case of the electronic device or detached from the case for repairing, and also meets the demand of reduced-size design. When the user applies a force to the pressing portion of the flexible button, the actuating portion of the flexible button may produce expansive deformation to actuate the switch component. At this time, the actuated switch component emits an electrical signal, such that the electronic device produces a corresponding controlling function. Accordingly, it is very easy for the user to operate the key assembly of the invention. On the other hand, the water-resistant portion of the flexible button is firmly abutted against the case so as to cover the through hole which communicates the outer environment with the interior of the case, and prevent ambient moisture or dust from entering the interior of the case, which helps to prolong the service life and improve reliability of the electronic component in the case.

In order to make the aforementioned features and advantages of the invention more comprehensible, embodiments accompanying figures are described in detail below.

DESCRIPTION OF EMBODIMENTS

Figure 1:
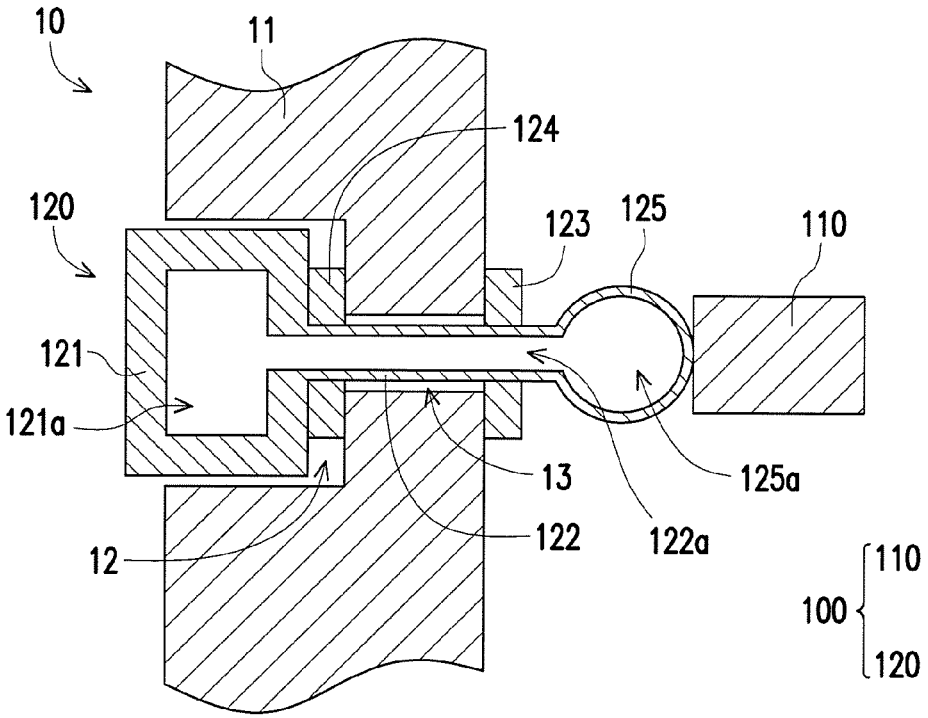
FIG. 1 is a partial sectional view illustrating a key assembly configured in an electronic device according to an embodiment of the invention.

FIG. 1 is a partial sectional view illustrating a key assembly configured in an electronic device according to an embodiment of the invention. Referring to FIG. 1, in the embodiment, a key assembly 100 may be configured in an electronic device 10, wherein the electronic device 10 may be a smart phone, a tablet PC, a notebook computer or other suitable electronic products. The key assembly 100 includes a switch component 110 and a flexible button 120. The switch component 110 is disposed in a case 11 of the electronic device 10 and electrically coupled to a processing unit (not shown) of the electronic device 10. Generally speaking, the case 11 may be a metal case, plastic case, a carbon fiber case, a composite case formed of plastic and metal, or a composite case formed of carbon fiber and metal, which has an opening 12 and a through hole 13 provided for accommodating of the key assembly 100. The opening 12 and the through hole 13 communicate with each other, wherein the opening 12 is exposed from the case 11 and communicates with the interior of the case 11 via the through hole 13.

The material of the flexible button 120 is, for example, rubber, and may be fabricated by using injection molding technology. Specifically, the flexible button 120 has a pressing portion 121, a shaft portion 122, a first water-resistant portion 123, a second water-resistant portion 124 and an actuating portion 125, which is, for example, an integrally formed structure. The pressing portion 121 and the actuating portion 125 are respectively disposed at two opposite sides of the shaft portion 122 and connected to the shaft portion 122. On the other hand, the first water-resistant portion 123 and the second water-resistant portion 124 are respectively connected to the shaft portion 122, and may be, for example, a protruding ring on the shaft portion 122. In the embodiment, the flexible button 120 has the characteristic of being flexible and deformable, and is configured in the case 11 in a manner that, for example, the actuating portion 125, the first water-resistant portion 123 and the shaft portion 122 pass through the opening 12 and the through hole 13 in sequence, such that the actuating portion 125 and the switch component 110 in the case 11 are aligned to each other. Meanwhile, the actuating portion 125 is disposed between the pressing portion 121 and the switch component 110. The first water-resistant portion 123 and the second water-resistant portion 124 are respectively disposed at two opposite sides of the through hole 13, and respectively cover the through hole 13. In other words, the first water-resistant portion 123 is located in the interior of the case 11 and the second water-resistant portion 124 is located in the opening 12.

The gap between the first water-resistant portion 123 and the second water-resistant portion 124 are subject to the depth of the through hole 13; therefore, after the flexible button 120 is configured in the case 11, the first water-resistant portion 123 and the second water-resistant portion 124 are respectively firmly abutted at two opposite sides of the case 11 so as to cover the through hole 13 which communicates the outer environment with the interior of the case 11, and prevent ambient moisture or dust from entering the interior of the case 11. With such configuration, it is possible to prolong the service life and improve reliability of the electronic component in the case 11. That is to say, the gap between the first water-resistant portion 123 and the second water-resistant portion 124 is, for example, equivalent to the depth of the through hole 13.

As shown by FIG. 1, the flexible button 120 may be engaged with the structure of the case 11 via the first water-resistant portion 123 and the second water-resistant portion 124 so as to be fixed in the case 11. On the other hand, since the flexible button 120 has the characteristic of being flexible and deformable, it is easy to be assembled to the case 11 of the electronic device 10 and easy to be detached from the case 11 for repairing. Comparing with the construction of conventional key assembly which includes a keypad, a spring, a water-resistant member and a retaining ring, in the embodiment, the flexible button 120 enables the pressing portion 121, shaft portion 122, first water-resistant portion 123, second water-resistant portion 124 and the actuating portion 125 to be integrated as a whole, such that the overall size can be significantly reduced and meet the demand for reduced-size design.

After the flexible button 120 is assembled to the case 11, the pressing portion 121 thereof is exposed from the case 11 so it is easy for the user to operate. As shown by FIG. 1, at least a portion of the pressing portion 121 and the second water-resistant portion 124 are located in the opening 12 and adjacent to each other. The second water-resistant portion 124 is located between the pressing portion 121 and the through hole 13; that is, the pressing portion 121 abuts against the case 11 via the second water-resistant portion 124. On the other hand, the first water-resistant portion 123 is located between the actuating portion 125 and the through hole 13, and the first water-resistant portion 123 is, for example, kept in a distance from the actuating portion 125.

Figure 2:
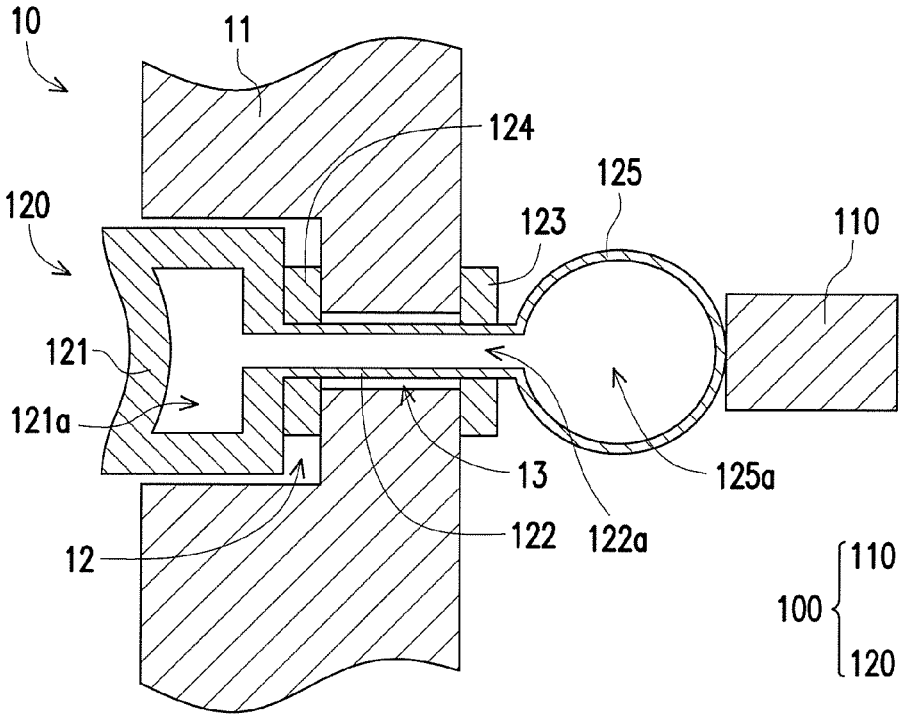
FIG. 2 is a schematic view illustrating that a force is applied to a pressing portion of the key assembly in FIG. 1.

FIG. 2 is a schematic view illustrating that a force is applied to the pressing portion of the key assembly in FIG. 1. Referring to FIG. 1 and FIG. 2, in the embodiment, the flexible button 120 further has a first cavity 121*a* located in the pressing portion 121, a communicating channel 122*a* located in the shaft portion 122, and a second cavity 125*a* located in the actuating portion 125. The communicating channel 122*a* communicates the first cavity 121*a* with the second cavity 125*a* such that the air in the first cavity 121*a*, communicating channel 122*a* and the second cavity 125*a* may flow reciprocately. On the other hand, the actuating portion 125 is, for example, abutted against the switch component 110. Since the actuating portion 125 is slightly abutted against the switch component 110, the switch component 110 is not actuated accordingly. When the user applies a force to the pressing portion 121, the pressing portion 121 produces compressive deformation, such that the size of the first cavity 121*a* reduces. After the air in the first cavity 121*a* is squeezed, the air flows into the second cavity 125*a* via the communicating channel 122*a*, such that the actuating portion 125 produces expansive deformation. The expanded and deformed actuating portion 125 pushes against the switch component 110 so as to actuate the switch component 110. The actuated switch component 110 emits an electrical signal, and the electrical signal is transmitted to a processing unit (not shown) of the electronic device 110 so as to generate a corresponding controlling function.

In the embodiment, a wall thickness of the actuating portion 125 is, for example, less than a wall thickness of the pressing portion 121 such that the actuating portion 125 produces a greater degree of expansive deformation after being pushed by the air flowing into the second cavity 125*a*. Also, it can be ensured that the switch component 110 can be actuated by the actuating portion 125 after the user applies the force to the pressing portion 121. On the other hand, when the force applied to the pressing portion 121 is removed, a portion of the air flows back to the first cavity 121*a* from the second cavity 125*a* via the communicating channel 122*a*, and the state is as shown by FIG. 1. It should be pointed out that, when the user applies the force to the pressing portion 121 again to actuate the switch component 110 via the actuating portion 125, the actuated switch component 110 emits another electrical signal, and the electrical signal is transmitted to the processing unit (not shown) of the electronic device 110, such that the processing unit (not shown) closes or stops the corresponding controlling function.

More embodiments are incorporated below for descriptions. It should be noted that the following embodiments have adopted component notations and part of the contents from the previous embodiment, wherein the same notations are used for representing the same or similar components, and descriptions of the same technical contents are omitted. The descriptions regarding to the omitted part may be referred to the previous embodiment, and thus is not repeated herein.

Figure 3:
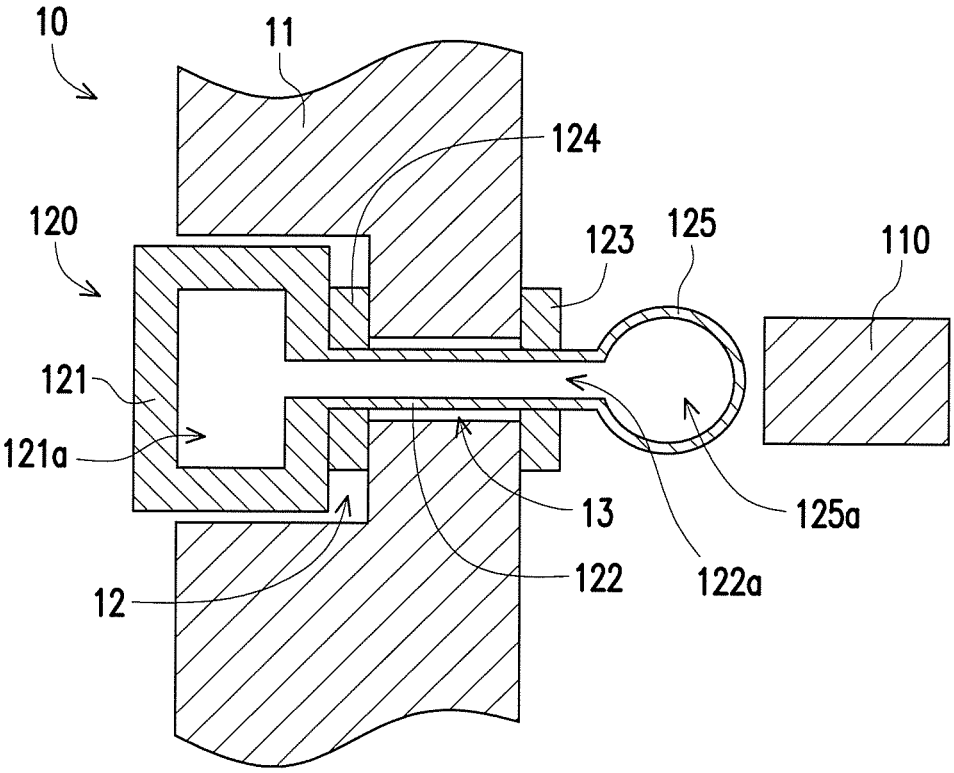
FIG. 3 is a partial sectional view illustrating a key assembly configured in an electronic device according to another embodiment of the invention.

FIG. 3 is a partial sectional view illustrating a key assembly configured in the electronic device according to another embodiment of the invention. Referring to FIG. 3, the difference between the key assembly of the embodiment and the key assembly 100 in the previous embodiment lies in that the actuating portion 125 of the key assembly in the embodiment is, for example, kept in a distance from the switch component 110, wherein the size of the gap is subject to the degree of the expansive deformation of the actuating portion 125 so as to ensure that the expanded and deformed actuating portion 125 can be abutted against the switch component 110 and actuate the switch component 110.

In summary, in the invention, the flexible button of the key assembly may be an integrally formed structure which is easy to be assembled to the case of the electronic device or detached from the case for repairing and meets the demand for reduced-size design. When the user applies the force to the pressing portion of the flexible button, the actuating portion of the flexible button produces expansive deformation and actuates the switch component. At this time, the actuated switch component emits the electrical signal such that the electronic device produces a corresponding controlling function. Accordingly, it is very easy for the user to operate the key assembly of the invention. On the other hand, the water-resistant portion of the flexible button is firmly abutted against the case so as to cover the through hole which communicates the external environment with the case, and prevent the ambient moisture or dust from entering the interior of the case. Accordingly, it is possible to improve the service life and reliability of the electronic component in the case.

Although the invention has been disclosed by the above embodiments, the embodiments are not intended to limit the invention. It will be apparent to those skilled in the art that various modifications and variations can be made to the structure of the invention without departing from the scope or spirit of the invention. Therefore, the protecting range of the invention falls in the appended claims.

What is claimed is:

1. A key assembly configured for being disposed in an electronic device, comprising:

a switch component, disposed in a case of the electronic device; and a flexible button, having a pressing portion, a shaft portion, at least a water-resistant portion and an actuating portion, wherein the flexible button is made of rubber, the pressing portion, the shaft portion, and the actuating portion are an integrally formed structure, the pressing portion is exposed from the case, the shaft portion connects the pressing portion and the actuating portion and passes through a through hole of the case, the water-resistant portion is connected to the shaft portion and covers the through hole, the actuating portion is disposed in the case and aligned to the switch component, and the flexible button further comprises a first cavity located in the pressing portion, a first communicating channel located in the shaft portion, and a second cavity located in the actuating portion, the communicating channel communicates the first cavity with the second cavity, and wherein when a force is applied to the pressing portion, the pressing portion is compressively deformed and a size of the first cavity is reduced, after air in the first cavity is squeezed, the air flows into the second cavity via the communicating channel so that the actuating portion is expansively deformed and the second cavity is expanded from a first volume to a second volume larger than the first volume so as to actuate the switch component.

2. The key assembly as claimed in claim 1, wherein a wall thickness of the actuating portion is less than a wall thickness of the pressing portion.

3. The key assembly as claimed in claim 1, wherein at least a portion of the pressing portion and the water-resistant portion are disposed in an opening of the case, the opening and the through hole communicate with each other.

4. The key assembly as claimed in claim 1, wherein the water-resistant portion and the pressing portion are adjacent to each other, and the water-resistant portion is disposed between the pressing portion and the through hole.

5. The key assembly as claimed in claim 1, wherein there are two water-resistant portions respectively disposed at two opposite sides of the through hole.

6. The key assembly as claimed in claim 5, wherein the water-resistant portion is disposed between the pressing portion and the through hole, the other one of the water-resistant portion is disposed between the actuating portion and the through hole, and the two water-resistant portions are respectively abutted against the case.

7. The key assembly as claimed in claim 1, wherein the actuating portion is disposed between the pressing portion and the switch component.

8. The key assembly as claimed in claim 1, wherein the actuating portion is abutted against the switch component.

9. The key assembly as claimed in claim 1, wherein the actuating portion is kept in a distance from the switch component.

* * * * *